US009711073B2

(12) United States Patent
Jun et al.

(10) Patent No.: US 9,711,073 B2
(45) Date of Patent: Jul. 18, 2017

(54) DISPLAY PANEL AND METHOD AND SYSTEM FOR CORRECTING DEFECTS ON THE DISPLAY PANEL

(71) Applicant: SAMSUNG DISPLAY CO., LTD., Yongin, Gyeonggi-do (KR)

(72) Inventors: Byung Geun Jun, Asan-si (KR); Min Cheol Kim, Asan-si (KR); In Hwan Kim, Asan-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 323 days.

(21) Appl. No.: 14/477,810

(22) Filed: Sep. 4, 2014

(65) Prior Publication Data

US 2015/0287350 A1 Oct. 8, 2015

(30) Foreign Application Priority Data

Apr. 2, 2014 (KR) ..... 10-2014-0039397

(51) Int. Cl.
*G09G 5/10* (2006.01)
*G09G 3/00* (2006.01)
(Continued)

(52) U.S. Cl.
CPC ..... *G09G 3/006* (2013.01); *G09G 3/3208* (2013.01); *G09G 3/3611* (2013.01);
(Continued)

(58) Field of Classification Search
CPC ..... G09G 3/006; G09G 3/3208
(Continued)

(56) References Cited

U.S. PATENT DOCUMENTS

2005/0259099 A1* 11/2005 Jo ..... G09G 3/3291 345/211
2008/0086582 A1* 4/2008 Park ..... G06F 13/4018 710/305
(Continued)

FOREIGN PATENT DOCUMENTS

KR 10-2006-0016648 A 2/2006
KR 10-2012-0092982 A 8/2012
(Continued)

*Primary Examiner* — Calvin C Ma
(74) *Attorney, Agent, or Firm* — Lewis Roca Rothgerber Christie LLP

(57) ABSTRACT

A system for correcting defects on a display panel includes: a signal supplier configured to supply a test signal corresponding to each of a first reference gray level, a second reference gray level, and a third reference gray level to the display panel; a luminance calculator configured to capture an image for each reference gray level displayed on the display panel in response to the test signal and to calculate luminance distribution data of the display panel for each reference gray level; and a correction data calculator configured to calculate correction data based on the luminance distribution data for each reference gray level, wherein the first, second, and third reference gray levels have different gray values, the third reference gray level corresponds to a maximum gray value of gray data input to the display panel, and the correction data increases the maximum gray value of the input gray data.

20 Claims, 12 Drawing Sheets

(51) Int. Cl.
*G09G 3/3208* (2016.01)
*G09G 3/36* (2006.01)

(52) U.S. Cl.
CPC ..... *G09G 2320/0233* (2013.01); *G09G 2320/0285* (2013.01); *G09G 2330/08* (2013.01); *G09G 2360/16* (2013.01)

(58) Field of Classification Search
USPC ..... 345/89, 208, 690
See application file for complete search history.

(56) References Cited

U.S. PATENT DOCUMENTS

| | | | | |
|---|---|---|---|---|
| 2009/0135211 | A1 | 5/2009 | Wang et al. | |
| 2013/0120659 | A1* | 5/2013 | Park | G06T 5/001 348/674 |
| 2013/0169619 | A1* | 7/2013 | Jeong | G09G 5/001 345/212 |
| 2014/0198134 | A1* | 7/2014 | Moon | G09G 5/10 345/690 |

FOREIGN PATENT DOCUMENTS

| | | | |
|---|---|---|---|
| KR | 10-2012-0108236 | A | 10/2012 |
| KR | 10-2013-0051751 | A | 5/2013 |

* cited by examiner

DISPLAY PANEL AND METHOD AND SYSTEM FOR CORRECTING DEFECTS ON THE DISPLAY PANEL

CROSS-REFERENCE TO RELATED APPLICATION

This application claims priority to and the benefit of Korean Patent Application No. 10-2014-0039397 filed on Apr. 2, 2014 in the Korean Intellectual Property Office, the disclosure of which is incorporated herein by reference in its entirety.

BACKGROUND

1. Field

Embodiments of the present invention relate to a display panel and a system and method for correcting defects (e.g., stains) on the display panel.

2. Description of the Related Art

Recently, one of the most widely used types of image displays is flat panel displays such as liquid displays (LCDs), plasma display panels (PDPs), and organic light-emitting diode (OLED) displays.

An image display includes a display panel that displays an image. All manufactured display panels go through an inspection process for detecting display defects (e.g., stains). Once a display defect is detected during the inspection process, a display panel having the display defect may go through a repair process. However, there are display defects (e.g., stains) that cannot be corrected by the repair process. Such display defects (e.g., stains) primarily result from overlapping exposures during multiple exposures of exposure equipment used in the process of forming thin-film patterns and a difference in exposure due to aberrations of multi-lenses. The difference in exposure changes the width of thin-film patterns, which, in turn, leads to a difference in parasitic capacitance of thin-film transistors, a difference in height of column spacers that maintain a cell gap, a difference in parasitic capacitance between signal lines, etc. These differences cause a difference in luminance, thus creating shaped defects (e.g., stains) in the form of vertical or horizontal lines. In addition, as the gap between a liquid crystal panel and a backlight unit is reduced to produce a slimmer display, a light diffusion path is reduced, thus creating shaped defects (e.g., stains) in the form of horizontal lines corresponding to the locations of a plurality of lamps. Defects (e.g., stains) may include not only the shaped defects (e.g., stains) but also irregular shapeless defects (e.g., stains) formed by a process defect such as the introduction of foreign matter or pinholes.

SUMMARY

Aspects of embodiments of the present invention provide a system for correcting defects (e.g., stains) on a display panel.

Aspects of embodiments of the present invention also provide a method of correcting defects (e.g., stains) on a display panel.

Aspects of embodiments of the present invention also provide a display panel having defects (e.g., stains) on a display unit corrected.

However, aspects of the present invention are not restricted to the ones set forth herein. The above and other aspects of the present invention will become more apparent to one of ordinary skill in the art to which embodiments of the present invention pertains by referencing the detailed description of embodiments of the present invention given below.

According to an embodiment of the present invention, there is provided a system for correcting defects on a display panel, the system including: a signal supplier configured to supply a test signal corresponding to each of a first reference gray level, a second reference gray level, and a third reference gray level to the display panel; a luminance calculator configured to capture an image for each reference gray level displayed on the display panel in response to the test signal and to calculate luminance distribution data of the display panel for each reference gray level; and a correction data calculator configured to calculate correction data based on the luminance distribution data for each reference gray level, wherein the first, second, and third reference gray levels have different gray values, the third reference gray level corresponds to a maximum gray value of gray data input to the display panel, and the correction data increases the maximum gray value of the input gray data.

The display panel may include a plurality of pixels arranged in a matrix, and the correction data calculator may be configured to set any one of the pixels as a reference pixel.

The correction data calculator may be configured to correct luminance values of correction pixels of the pixels other than the reference pixel to have substantially same luminance values as a luminance value of the reference pixel.

The correction data calculator may be configured to calculate first correction data for correcting gray values of input data of the correction pixels in a range of the first reference gray level to the second reference gray level such that the correction pixels have same luminance values as that of the reference pixel in the range of the first reference gray level to the second reference gray level.

With reference to the first correction data, the correction data calculator may be configured to calculate third correction data for correcting gray values of input data of the correction pixels in a range of a gray level of zero to the first reference gray level such that the correction pixels have same luminance values as that of the reference pixel in the range of the gray level of zero to the first reference gray level.

The correction data calculator may be configured to calculate second correction data for correcting gray values of input data of the correction pixels in a range of the second reference gray level to the third reference gray level such that the correction pixels have same luminance values as that of the reference pixel in the range of the second reference gray level to the third reference gray level.

The correction data calculator may be configured to set one of the pixels having an average luminance value as the reference pixel.

The correction data calculator may be configured to correct the luminance distribution data for each reference gray level by linearizing a change in luminance values of the pixels according to a gray level.

The luminance calculator may include: an image acquirer configured to acquire an image of the display panel by capturing the display panel; and a first controller configured to calculate the luminance distribution data of the display panel.

The correction data calculator may include: a second controller configured to calculate correction data based on the luminance distribution data for each reference gray level;

and a memory configured to store the correction data in the form of a lookup table (LUT).

According to another embodiment of the present invention, there is provided a method of correcting defects on a display panel, the method including: acquiring image data of an image for each reference gray level by capturing the display panel which is configured to display an image corresponding to each of a first reference gray level, a second reference gray level, and a third reference gray level; calculating luminance distribution data of the display panel for each reference gray level based on the image data of the image for each reference gray level; calculating correction data based on the luminance distribution data for each reference gray level; and correcting gray data input to the display panel by using the correction data, wherein the first, second, and third reference gray levels have different gray values, the third reference gray level corresponds to a maximum gray value of gray data input to the display panel, and the correction data increases the maximum gray value of the input gray data.

The display panel may include a plurality of pixels arranged in a matrix, and the method may further include setting any one of the pixels as a reference pixel.

In the calculating of the correction data, luminance values of correction pixels of the pixels other than the reference pixel may be corrected to have substantially same luminance values as a luminance value of the reference pixel.

In the calculating of the correction data, first correction data for correcting gray values of input data of the correction pixels in a range of the first reference gray level to the second reference gray level may be calculated such that the correction pixels have same luminance values as that of the reference pixel in the range of the first reference gray level to the second reference gray level.

In the calculating of the correction data, third correction data for correcting gray values of input data of the correction pixels in a range of a gray level of zero to the first reference gray level may be calculated with reference to the first correction data such that the correction pixels have same luminance values as that of the reference pixel in the range of the gray level of zero to the first reference gray level.

In the calculating of the correction data, second correction data for correcting gray values of input data of the correction pixels in a range of the second reference gray level to the third reference gray level may be calculated such that the correction pixels have same luminance values as that of the reference pixel in the range of the second reference gray level to the third reference gray level.

The calculating of the correction data may further include correcting the luminance distribution data for each reference gray level by linearizing a change in luminance values of the pixels according to a gray level.

According to another embodiment of the present invention, there is provided a display panel including: a display unit including a plurality of pixels arranged in a matrix and in which at least one of the pixels is set as a reference pixel; a scan driver configured to transmit a scan signal to the display unit; a data corrector configured to generate corrected gray data by correcting gray data input to correction pixels other than the reference pixel; and a data driver configured to generate a data voltage by converting the corrected gray data and to apply the data voltage to the display unit, wherein the data corrector is configured to increase a maximum gray value of the input gray data.

The corrected gray data may have a greater number of bits than the input gray data, and the data driver may include a digital-analog converter which corresponds to the number of bits of the corrected gray data.

The input gray data may be an 8-bit signal, and the corrected gray data may be a 9-bit signal.

BRIEF DESCRIPTION OF THE DRAWINGS

The above and other aspects and features of the present invention will become more apparent by describing in detail example embodiments thereof with reference to the attached drawings, in which.

DETAILED DESCRIPTION

Figure 1:
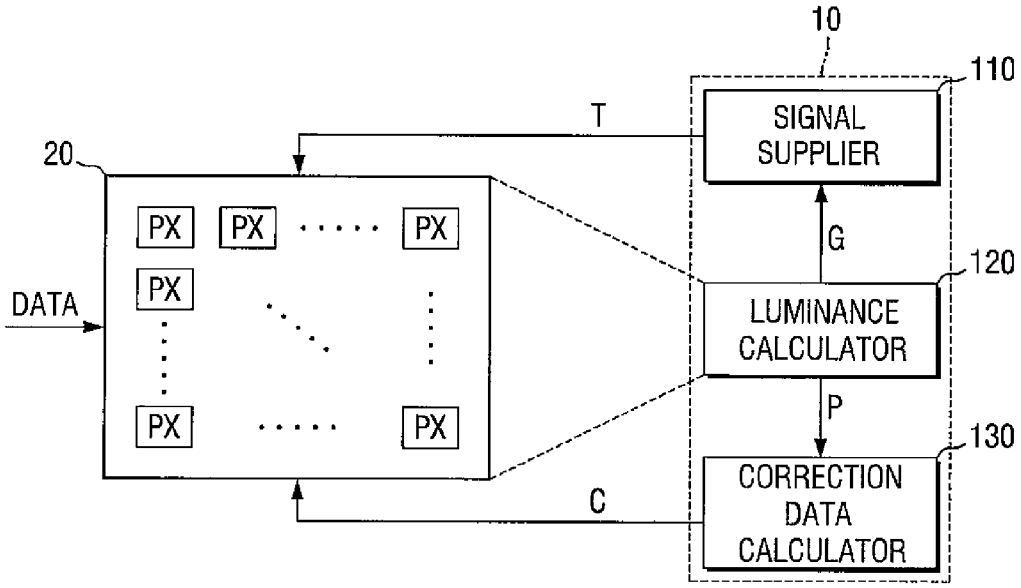
FIG. 1 is a block diagram of a system for correcting defects (e.g., stains) on a display panel according to an embodiment of the present invention.

The aspects and features of the present invention and methods for achieving the aspects and features will be apparent by referring to the embodiments to be described in detail with reference to the accompanying drawings. However, the present invention is not limited to the embodiments disclosed hereinafter, but can be implemented in diverse forms. The matters defined in the description, such as the detailed construction and elements, are nothing but specific details provided to assist those of ordinary skill in the art in a comprehensive understanding of the invention, and the present invention is only defined within the scope of the appended claims, and equivalents thereof.

The term "on" that is used to designate that an element is on another element or located on a different layer or a layer includes both a case where an element is located directly on another element or a layer and a case where an element is located on another element via another layer or still another element. In the entire description of the present invention, the same drawing reference numerals are used for the same elements across various figures. When a first element is described as being "coupled" or "connected" to a second element, the first element may be directly "coupled" or "connected" to the second element, or one or more other intervening elements may be located between the first element and the second element.

Although the terms "first, second, and so forth" are used to describe diverse constituent elements, such constituent elements are not limited by the terms. The terms are used only to discriminate a constituent element from other constituent elements. Accordingly, in the following description, a first constituent element may be a second constituent element, for example.

Hereinafter, embodiments of the present invention will be described with reference to the attached drawings.

Figure 2:
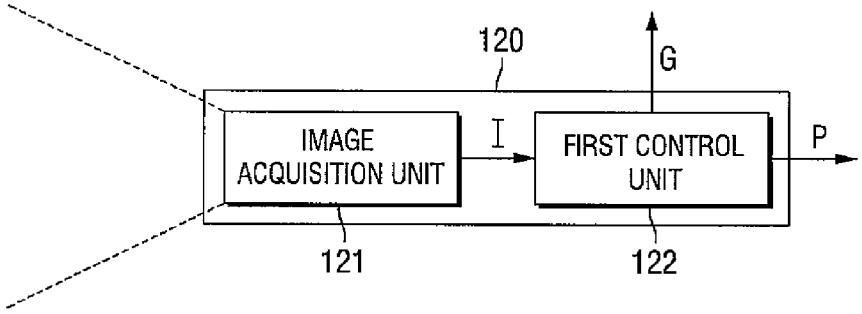
FIG. 2 is a block diagram of a luminance calculator according to an embodiment of the present invention.
Figure 3:
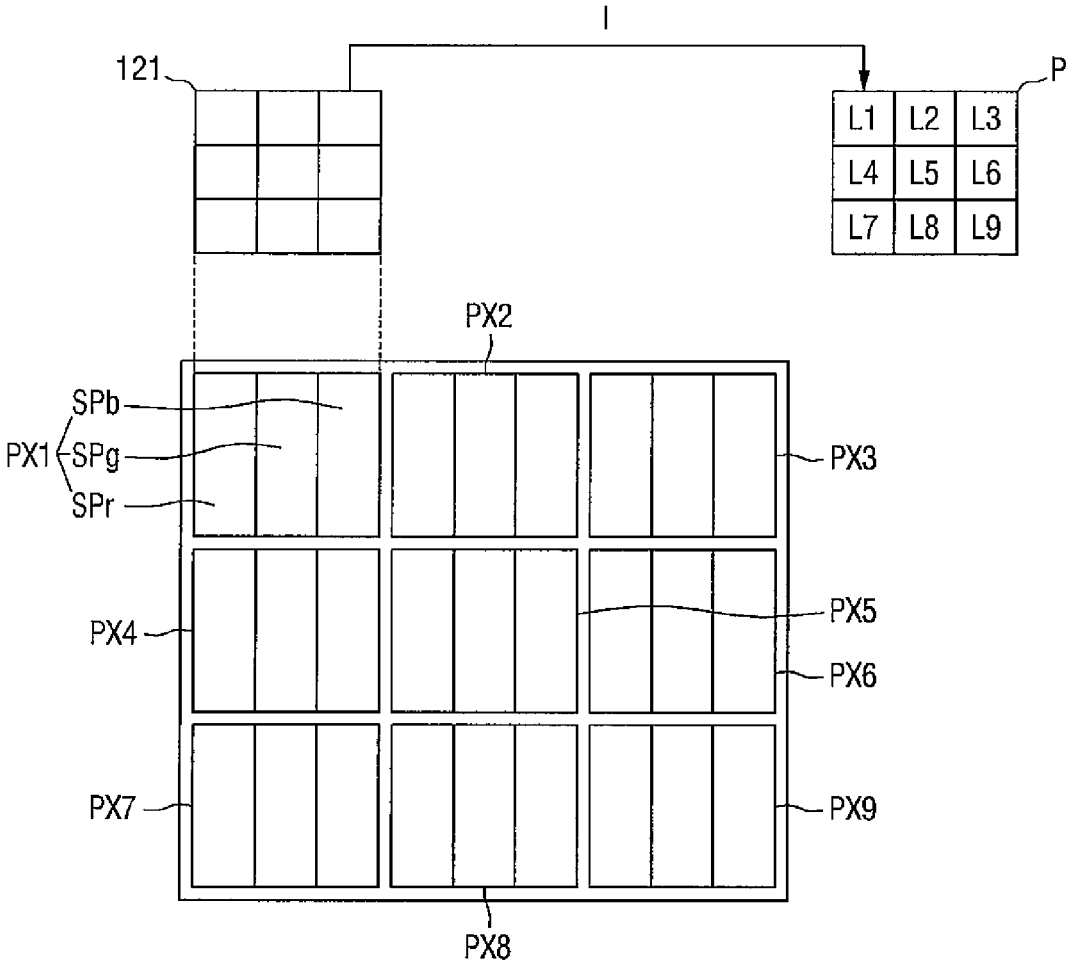
FIG. 3 is a schematic diagram of a display panel and an image acquisition unit which captures an image displayed on the display panel according to an embodiment of the present invention.
Figure 4:
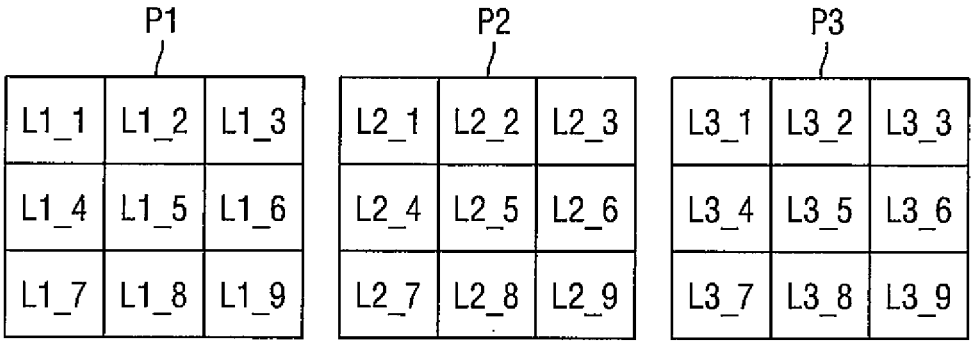
FIG. 4 is a schematic diagram of first through third luminance distribution data according to an embodiment of the present invention.
Figure 5:
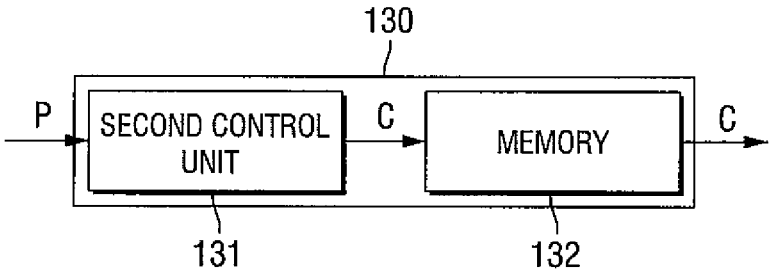
FIG. 5 is a block diagram of a correction data calculator according to an embodiment of the present invention.

FIG. 1 is a block diagram of a system 10 for correcting defects (e.g., stains) on a display panel according to an embodiment of the present invention. FIG. 2 is a block diagram of a luminance calculator 120 according to an embodiment of the present invention. FIG. 3 is a schematic diagram of a display panel 20 and an image acquisition unit (or image acquirer) 121 which captures an image displayed on the display panel 20. FIG. 4 is a schematic diagram of first through third luminance distribution data P1 through P3. FIG. 5 is a block diagram of a correction data calculator 130.

Referring to FIGS. 1 through 5, the stain correction system (or defect correction system) 10 includes a signal supplier 110, the luminance calculator 120, and the correction data calculator 130.

The signal supplier 110 may provide a test signal T to the display panel 20. The signal supplier 110 may provide the test signal T corresponding to each reference gray level (e.g., preset reference gray level) to the display panel 20. The signal supplier 110 may provide the test signal T corresponding to each of a first reference gray level G1, a second reference gray level G2, and a third reference gray level G3 to the display panel 20. The signal supplier 110 may change a reference gray level (e.g., a set reference gray level) in response to a gray change signal G received from the luminance calculator 120. The first through third reference gray levels G1 through G3 may have different gray values. A gray value of the first reference gray level G1 may be lower than that of the second reference gray level G2, and the third reference gray level G3 may correspond to a maximum gray value of gray data input to the display panel 20. For example, the first reference gray level G1 may have a gray value of 35, the second reference gray level G2 may have a gray value of 87, the third reference gray level G3 may have a gray value of 255, and the test signal T may be an 8-bit signal. However, the present invention is not limited to this example.

The display panel 20 is a panel that displays an image. The display panel 20 may be a liquid crystal display (LCD) panel, an electrophoretic display panel, an organic light-emitting diode (OLED) panel, a light-emitting diode (LED) panel, an inorganic electroluminescent (EL) display panel, a field emission display (FED) panel, a surface-conduction electron-emitter display (SED) panel, a plasma display panel (PDP), or a cathode ray tube (CRT) display panel. An OLED panel will hereinafter be described as an example of the display panel 20. However, the display panel 20 according to embodiments of the present invention is not limited to the OLED panel, and various types of display devices and display panels can be used.

In response to the test signal T, the display panel 20 may display an image having a different luminance value according to the reference gray level G1, G2 or G3. The display panel 20 may include a plurality of pixels PX arranged in a matrix. The pixels PX may be arranged in a 3×3 matrix as illustrated in FIG. 3, but the arrangement of the pixels PX is not limited to the 3×3 matrix. Each of the pixels PX includes an organic light-emitting element and can emit light by itself. The pixels PX may have different luminances due to shaped defects (e.g., stains) formed by a difference in light exposure, a difference in height of column spacers or a difference in parasitic capacitance between signal lines, as well as shapeless defects (e.g., stains) formed by a process defect such as introduction of foreign matter or pinholes.

The luminance calculator 120 may acquire an image for each reference gray level G1, G2 or G3 displayed on the display panel 20. In addition, the luminance calculator 120 may calculate luminance distribution data P of the display panel 20 based on the acquired image for each reference gray level G1, G2 or G3. The luminance calculator 120 may include the image acquisition unit 121 and a first control unit 122.

The image acquisition unit (or image acquirer) 121 may acquire an image for each reference gray level displayed on the display panel 20. The image acquisition unit 121 may be composed of a camera. The image acquisition unit 121 may capture an image displayed on the display panel 20 and provide image data I of the captured image to the first control unit (or first controller) 122. The image acquisition unit 121 may be a 3×3 charge coupled device (CCD) camera including nine cells. That is, an image displayed on the display panel 20 may be charged in each cell of the image acquisition unit 121 as an optical signal. Then, the image acquisition unit 121 may generate the image data I by converting the optical signal into an electrical signal. However, the configuration of the image acquisition unit 121 is not limited to the above example.

The image acquisition unit 121 may be aligned to match each of the pixels PX. That is, as illustrated in FIG. 3, the image acquisition unit 121 may be aligned to focus the camera on a first pixel PX1. In some embodiments, the image acquisition unit 121 may be provided in a plurality, and the image acquisition units 121 may be arranged to match the pixels PX, respectively. The aligned image acquisition unit 121 may generate the image data I by capturing the first pixel PX1. Here, the display panel 20 may be displaying an image corresponding to any one of the reference gray levels G1, G2 and G3 in response to the test signal T. Each of the pixels PX may include subpixels SPr, SPg and SPb which display red, green and blue, respectively, and the image data I may be generated for each of the subpixels SPr, SPg and SPb. That is, the image acquisition unit 121 may generate the image data I for each subpixel SPr, SPg or SPb which emits light corresponding to the first reference gray level G1, the second reference gray level G2 or the third gray level G3 and may transmit the generated image data I to the first control unit 122. However, the present invention is not limited thereto, and the image data I for all pixels PX which display red, green and blue may also be generated.

The first control unit 122 may calculate the luminance distribution data P of the display panel 20 by converting the image data I. The first control unit 122 may include a temporary memory, and the image data I acquired by the image acquisition unit 121 may be stored in the temporary memory. The first control unit 122 may convert each image data I into a luminance value in view of exposure time, lens focus characteristics, boundary surface correction, camera noise, etc. and calculate the luminance distribution data P of the display panel 20. That is, a first luminance L1 of the luminance distribution data P may correspond to the first pixel PX1, a second luminance L2 may correspond to a second pixel PX2, and a third luminance L3 may correspond to a third pixel PX3. Here, the first luminance L1 may be generated by capturing any one of the subpixels SPr, SPg and SPb of the first pixel PX1. However, the present invention is not limited thereto, and the first luminance L1 may also be generated by combining the image data I of each of the subpixels SPr, SPg and SPb, or by capturing all subpixels SPr, SPg and SPb in a state where all of the subpixels SPr, SPg and SPb are emitting light.

The first control unit 122 may calculate first luminance distribution data P1 corresponding to the first reference gray level G1, second luminance distribution data P2 corresponding to the second reference gray level G2, and third luminance distribution data P3 corresponding to the third reference gray level G3. That is, after calculating the first luminance distribution data P1, the first control unit 122 may instruct the signal supplier 110 to change the gray level of the test signal T to the second gray level G2 by outputting the gray change signal G to the signal supplier 110. In addition, after calculating the second luminance distribution data P2, the first control unit 122 may instruct the signal supplier 110 to change the gray level of the test signal T to the third gray level G3 by outputting the gray change signal G to the signal supplier 110. After finally calculating the third luminance distribution data P3, the first control unit 122 may instruct the signal supplier 110 to stop providing the test signal T by outputting the gray change signal G to the signal supplier 110.

Referring to FIG. 4, a first luminance L1_1 of the first luminance distribution data P1 may be luminance data calculated by capturing the first pixel PX1 having the first gray level G1, and a first luminance L2_1 of the second luminance distribution data P2 may be luminance data calculated by capturing the first pixel PX1 having the second gray level G2. Here, since the first gray level G1 has a relatively lower gray value than the second gray level G2, the overall luminance value of the first luminance distribution data P1 may be lower than that of the second luminance distribution data P2. As described above, the third gray level G3 may be the maximum gray level of gray data input to the display panel 20. Therefore, a luminance value of the third luminance distribution data P3 corresponding to the third gray level G3 may be greater than that of each of the first and second luminance distribution data P1 and P2. The first through ninth luminances L1 through L9 of the luminance distribution data P1, P2 or P3 corresponding to each reference gray level may be data having different luminance values due to the above-described shaped or shapeless defects (e.g., stains). The first control unit 122 may output the calculated luminance distribution data P to the correction data calculator 130.

The correction data calculator 130 may calculate correction data C based on the luminance distribution data P for each reference gray level. The correction data calculator 130 may include a second control unit (or second controller) 131 and a memory unit (or memory) 132. The second control unit 131 may include a temporary memory and temporarily store the luminance distribution data P provided by the luminance calculator 120 in the temporary memory. The second control unit 131 may calculate the correction data C based on the luminance distribution data P for each reference gray level and output the correction data C to the memory unit 132.

The memory unit 132 may store the calculated correction data C and provide the calculated correction data C to the display panel 20. The display panel 20 may correct gray data DATA input from an external source by using the correction data C. Here, the correction data C may increase or decrease a gray value of the input gray data DATA. In addition, the correction data C may increase a maximum gray value of the input gray data DATA. The correction data C may be stored in the form of a lookup table (LUT).

The correction data C may be used to adjust luminances of pixels to a luminance of a particular pixel of the display panel 20. The correction data calculator 130 may set any one of the pixels PX of the display panel 20 as a reference pixel. The correction data calculator 130 may set a pixel whose luminance corresponds to the average luminance as the reference pixel or a pixel corresponding to a center of the display panel 20 as the reference pixel. However, a method of setting the reference pixel is not limited to the above examples. For ease of description, as an example, a fifth pixel PX5 will be set as the reference pixel, and pixels PX excluding the reference pixel PX5 will be defined as correction pixels. The correction data C may be applied to the correction pixels excluding the reference pixel PX5. The correction data C may be used to correct gray data input to the correction pixels, so that the luminances of the correction pixels can be adjusted to the luminance of the reference pixel PX5. Hereinafter, a method of generating the correction data C using the correction data calculator 130 will be described in greater detail.

Figure 6:
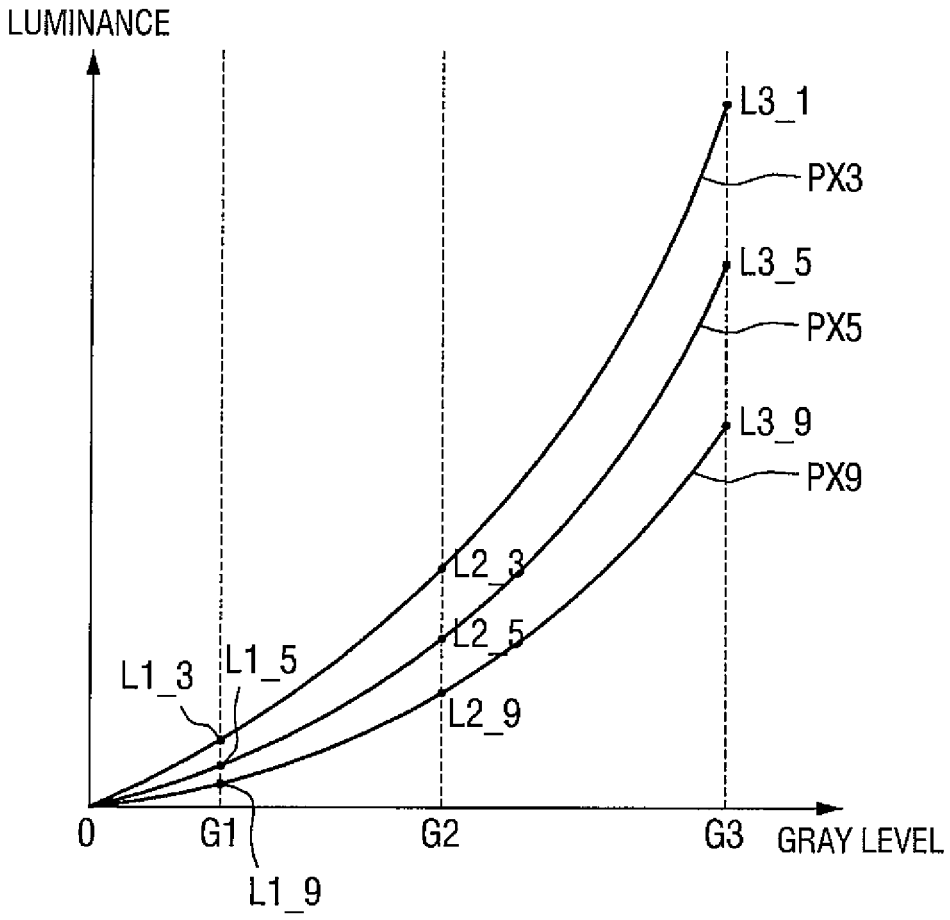
FIG. 6 is a graph illustrating gray level-luminance curves of a plurality of pixels.
Figure 7:
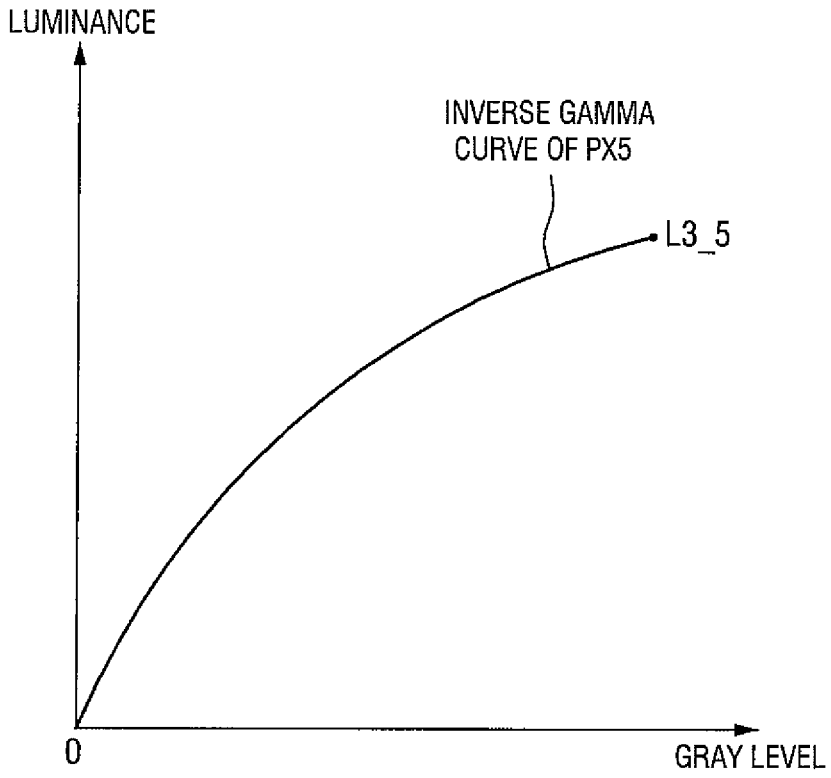
FIG. 7 is a graph illustrating an inverse function of a gray level-luminance curve of a reference pixel.
Figure 8:
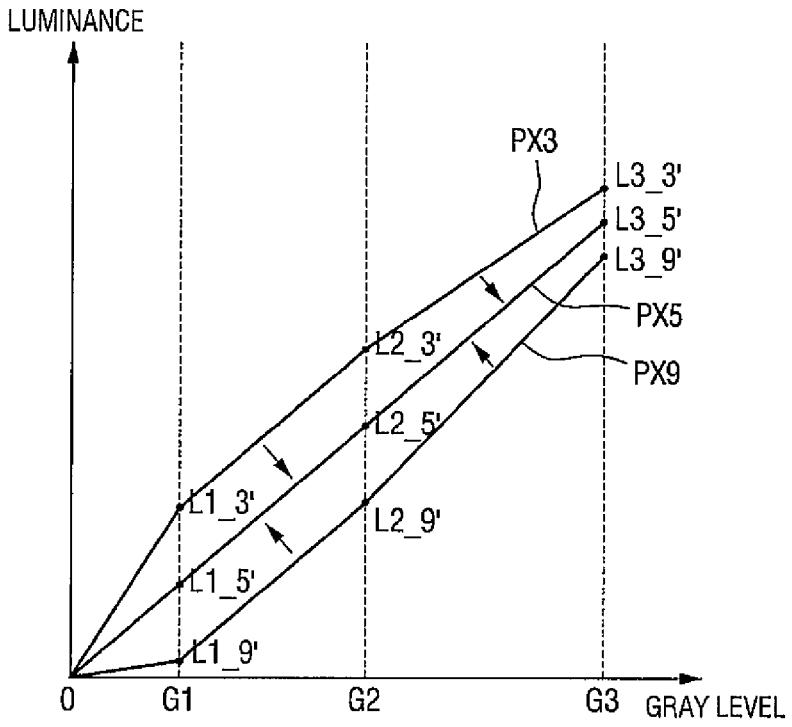
FIG. 8 illustrates linearized gray level-luminance graphs of the pixels.
Figure 9:
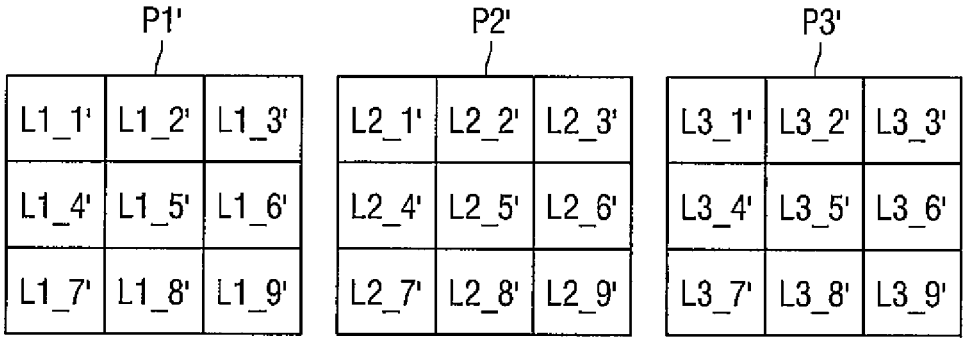
FIG. 9 is a schematic diagram illustrating first through third linearized luminance distribution data according to an embodiment of the present invention.
Figure 10:
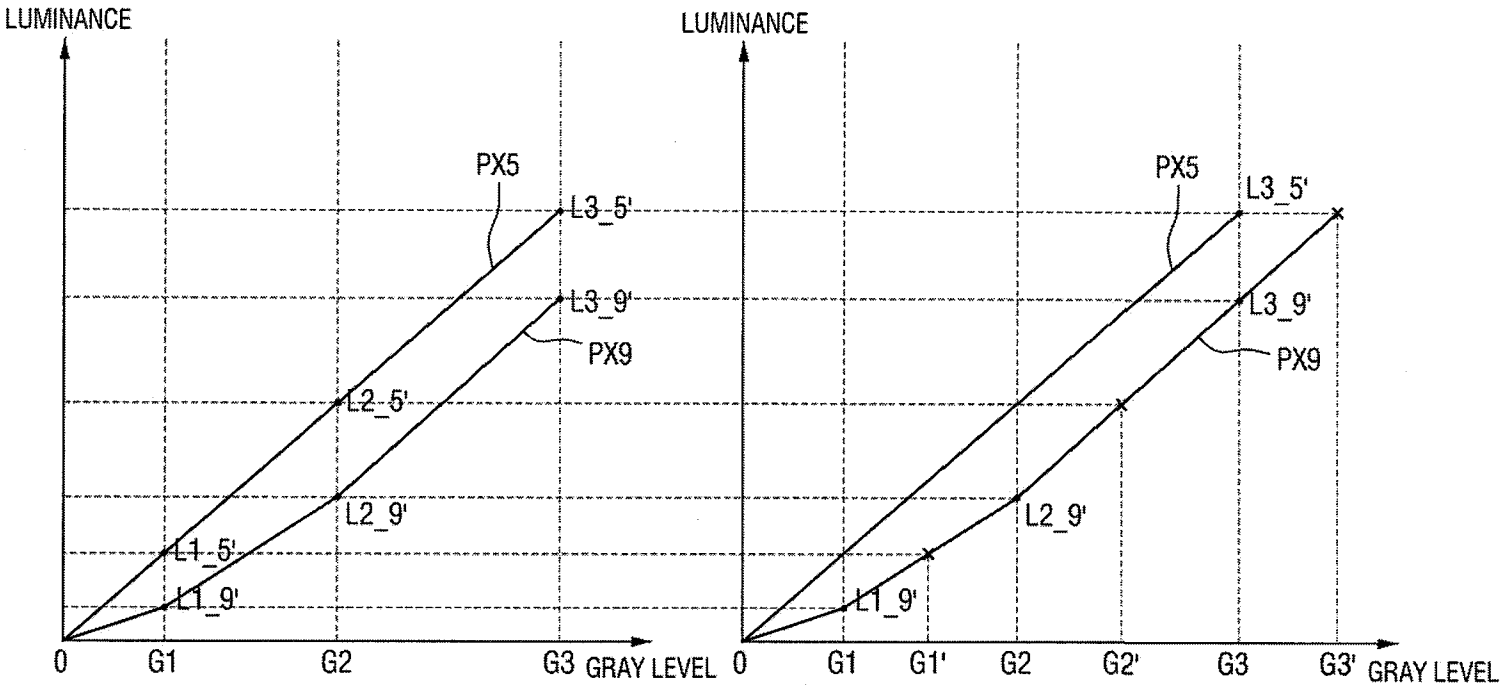
FIG. 10 is a graph illustrating the relationship between the luminance of the reference pixel and that of a correction pixel.
Figure 11:
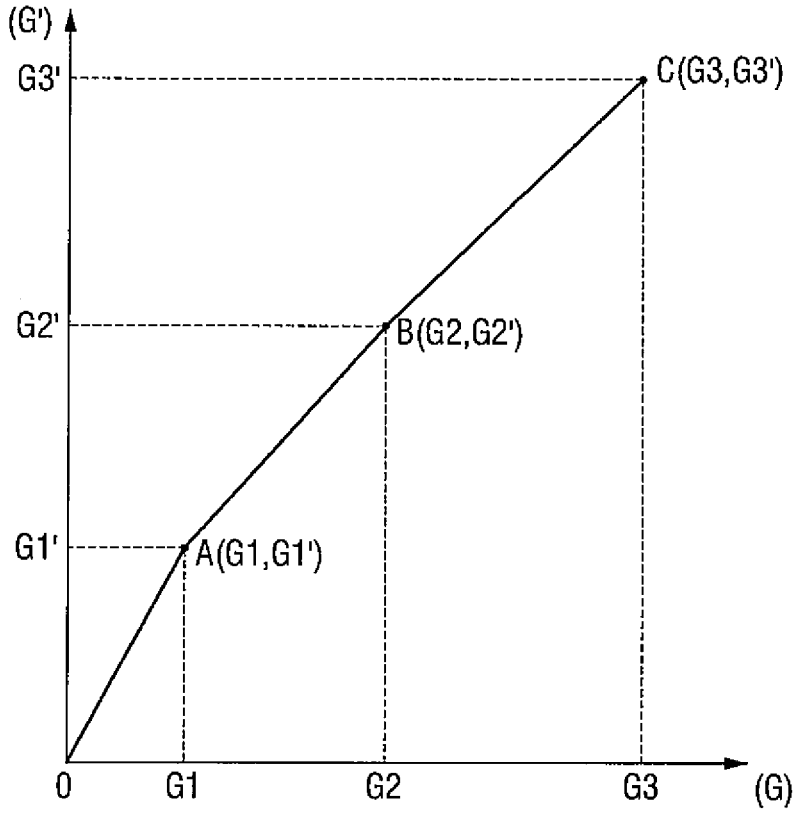
FIG. 11 is a graph illustrating the relationship between an uncorrected gray level and a corrected gray level of a correction pixel.

FIG. 6 is a graph illustrating gray level-luminance curves of a plurality of pixels. FIG. 7 is a graph illustrating an inverse function of a gray level-luminance curve of a reference pixel. FIG. 8 illustrates linearized gray level-luminance graphs of the pixels. FIG. 9 is a schematic diagram illustrating first through third corrected luminance distribution data P1' through P3'. FIG. 10 is a graph illustrating the relationship between the luminance of the reference pixel and that of a correction pixel. FIG. 11 is a graph illustrating the relationship between an uncorrected gray level and a corrected gray level of a correction pixel.

Referring to FIGS. 6 through 11, the correction data calculator 130 may correct the luminance distribution data P by linearizing a change in luminances of a plurality of pixels PX according to a gray level. That is, the correction data calculator 130 may correct the luminance distribution data P by linearizing gray level-luminance curves of the pixels PX for a more accurate calculation of the correction data C.

Referring to FIG. 6, each pixel may be a gamma curve representing a luminance that increases as a gray level increases. Here, the fifth pixel PX5 may be the reference pixel. The third pixel PX3 and the ninth pixel PX9 may be examples of correction pixels, and the following description may apply the same to the other correction pixels. An increase in the luminance of each pixel may not be proportional to an increase in the gray level thereof. That is, the gray level-luminance curve of each pixel can be presented in the form of an $N^{th}$-degree function. For a more accurate correction, the correction data calculator 130 may linearize the reference pixel into a linear function. If the gray level-luminance curve of the fifth pixel PX5 set as the reference pixel is defined as a linear function, the correction data calculator 130 may linearize a plurality of pixels PX by multiplying the pixels PX by an inverse function of the linear function. The inverse function of the fifth pixel PX5 may be as illustrated in FIG. 7.

FIG. 8 schematically illustrates linearized gamma graphs obtained by multiplying the third pixel PX3, the fifth pixel PX5 and the ninth pixel PX9 by the inverse function of the fifth pixel PX5 (i.e., the reference pixel). The graph of the fifth pixel PX5 illustrated in FIG. 8 may be a straight line with respect to which the curve of the fifth pixel PX5 illustrated in FIG. 6 and the curve of the fifth pixel PX5 illustrated in FIG. 7 are symmetrical to each other. In addition, the graph of the fifth pixel PX5 illustrated in FIG. 8 may be a straight line having the same (or a constant) slope from a gray level of zero to the third reference gray level G3. Each of the third pixel PX3 and the ninth pixel PX9 (i.e., the correction pixels) may be divided into three ranges; a range of the gray level of zero to the first reference gray level G1, a range of the first reference gray level G1 to the second reference gray level G2, and a range of the second reference gray level G2 to the third reference gray level G3. Each of the third pixel PX3 and the ninth pixel PX9 may be a linear gamma graph having a different slope in each range. On the linearized gamma graph, each pixel may have a different luminance value from the luminance value on the nonlinear gamma graph. That is, the luminances of the first through third corrected luminance distribution data P1' through P3' may be different from those of the first through third luminance distribution data P1 through P3, respectively. The luminance of each correction pixel may be corrected to the luminance of the reference pixel based on the first through third corrected luminance distribution data P1' through P3'.

Referring to FIG. 10, the linearized fifth pixel PX5 (i.e., the reference pixel) may have a luminance value of L1_5' at the first reference gray level G1, a luminance value of L2_5' at the second reference gray level G2, and a luminance value of L3_5' at the third reference gray level G3. The linearized ninth pixel PX9 (i.e., a correction pixel) may have a luminance value of L1_9' at the first reference gray level G1, a luminance value of L2_9' at the second reference gray level G2, and a luminance value of L3_9' at the third reference gray level G3. Here, the luminance value of the ninth pixel PX9 at each reference gray level G1, G2 or G3 may be lower than that of the fifth pixel PX5 at each reference gray level G1, G2 or G3. On the linearized gamma graph of the ninth pixel PX9, a gray value corresponding to the luminance value of L1_5' may be G1', a gray value corresponding to the luminance value of L2_5' may be G2', and a gray value corresponding to the luminance value of L3_5' may be G3'. That is, the fifth pixel PX5 may have the luminance value of L1_5' at the gray value of G1', the luminance value of L2_5' at the gray value of G2', and the luminance value of L3_5' at the gray value of G3'. Therefore, if gray data input to the ninth pixel PX9 is corrected to correspond to each of the gray values of G1', G2' and G3', the ninth pixel PX9 may have substantially the same luminance as the fifth pixel PX5.

As described above, a correction pixel may have a straight line having a different slope in each gray range. Therefore, the correction data C calculated may be different in each gray range. That is, first correction data C1 may be calculated for the range from the first reference gray level G1 to the second reference gray level G2, second correction data C2 may be calculated for the range from the second reference gray level G2 to the third reference gray level G3, and the third correction data C3 may be calculated for the range from the gray level of zero to the first reference gray level G1. For example, the gray level of zero may be a minimum gray level of gray data input to the display panel 20.

The first correction data C1 corresponding to the range from the first reference gray level G1 to the second reference gray level G2 may be calculated at a point A (G1, G1') and a point B (G2, G2'). That is, the first correction data C1 may be calculated by Equation (1) in the form of a linear equation:

$$G'=H1+S1\times G, \tag{1}$$

where G is input gray data, G' is corrected gray data, H1 is a first constant, and S1 is a first slope.

The second correction data C2 corresponding to the range from the second reference gray level G2 to the third reference gray level G3 may be calculated at the point B (G2, G2') and a point C (G3, G3'). That is, the second correction data C2 may be calculated by Equation (2) in the form of a linear equation:

$$G'=H2+S2\times G, \tag{2}$$

where G is input gray data, G' is corrected gray data, H2 is a second constant, and S2 is a second slope.

Since the luminance of the display panel 20 is low at a low gray level within the range from the gray level of zero to the first reference gray level G1, it is not easy to capture an image, making it difficult to accurately calculate the third correction data C3. Therefore, the third correction data C3 corresponding to the range from the gray level of zero to the first reference gray level G1 may be calculated by interpolation. Based on interpolation, the third correction data C3 may be calculated using Equation (3) below by reflecting the first constant H1 and the first slope S1 of the first correction data C1. However, the present invention is not limited thereto, and the third correction data C3 may also be calculated like the second correction data C2 is calculated by additionally measuring a luminance corresponding to a particular gray level, or may also be calculated by reflecting the second constant H2 and the second slope S2 of the second correction data C2.

$$G'=(H1/35+S1)\times G, \tag{3}$$

where G is input gray data, G' is corrected gray data, H1 is the first constant, and S1 is the first slope.

That is, the correction data calculator 130 may calculate the first correction data C1 used to correct gray values of input data of correction pixels in the range of the first reference gray level G1 to the second reference gray level G2 such that the correction pixels have the same luminance value as that of the reference pixel in the range of the first reference gray level G1 to the second reference gray level G2.

In addition, the correction data calculator 130 may calculate the second correction data C2 used to correct input gray values of the correction pixels in the range of the second reference gray level G2 to the third reference gray level G3 such that the correction pixels have the same luminance value as that of the reference pixel in the range of the second reference gray level G2 to the third reference gray level G3.

Also, with reference to the first correction data C1, the correction data calculator 130 may calculate the third correction data C3 used to correct gray values of input data of the correction pixels in the range of the gray level of zero to the first reference gray level G1 such that the correction pixels have the same luminance value as that of the reference pixel in the range of the gray level of zero to the first reference gray level G1. That is, the stain correction system 10 according to the current embodiment may calculate the first through third correction data C1 through C3 used to correct input gray values of correction pixels in the entire gray range from the minimum gray level (zero) to the maximum gray level (the third reference gray level G3). Since gray values of input gray data in the entire gray range can be corrected, more effective correction is possible. The first through third correction data C1 through C3 corresponding to each correction pixel may be stored in the memory unit 132 in the form of an LUT.

Since the correction data C is used to correct all gray values of gray data input to each correction pixel, a maximum gray value of the input gray data may increase. For example, if the input gray data is an 8-bit signal having a maximum gray level of 255, the maximum gray level of the input gray data corrected using the correction data C may increase to more than 255, and the corrected gray data may expand to become a 9-bit signal.

The stain correction system 10 according to the current embodiment can make the overall luminance of the display panel 20 uniform (or uniformly correct the overall luminance of the display panel 20) by correcting the luminances of correction pixels to correspond to that of the reference pixel. Accordingly, luminance non-uniformity due to defects (e.g., stains) can be corrected. In addition, since the stain correction system 10 corrects many gray levels (e.g., all gray levels) of input gray data, it can provide an increased (e.g., improved) correction effect.

A method of correcting defects (e.g., stains) on a display panel according to another embodiment of the present invention will now be described with reference to FIGS. 12 through 14.

Figure 12:
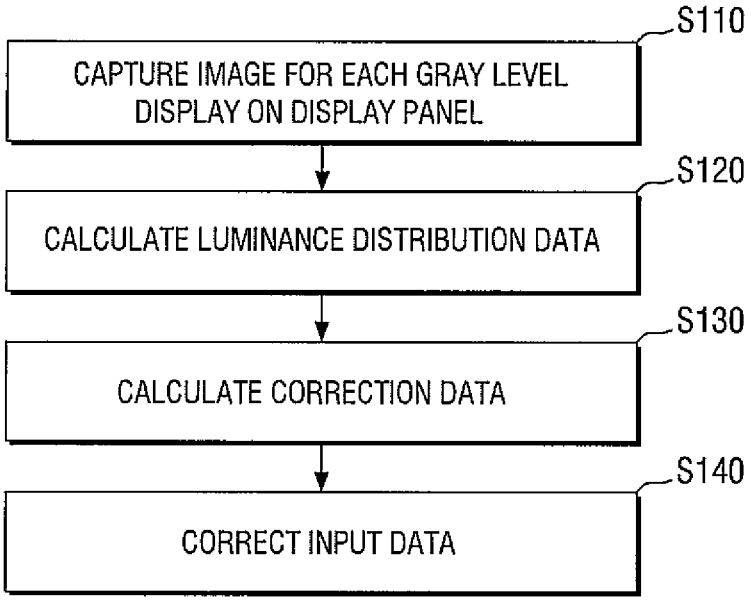
FIG. 12 is a flowchart illustrating a method of correcting defects (e.g., stains) on a display panel according to another embodiment of the present invention.

FIG. 12 is a flowchart illustrating a method of correcting defects (e.g., stains) on a display panel according to another embodiment of the present invention. FIG. 13 is a flowchart illustrating an operation of calculating correction data according to an embodiment of the present invention. FIG. 14 is a flowchart illustrating an operation of calculating correction data using corrected luminance distribution data according to an embodiment of the present invention.

Figure 13:
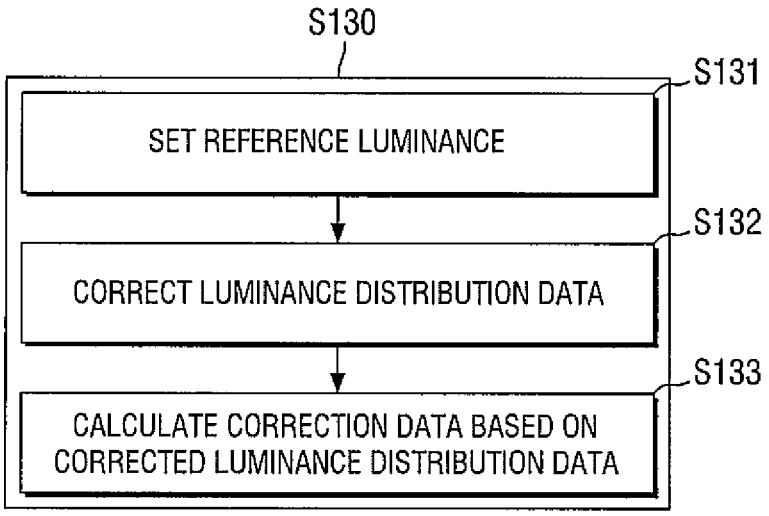
FIG. 13 is a flowchart illustrating an operation of calculating correction data according to an embodiment of the present invention.
Figure 14:
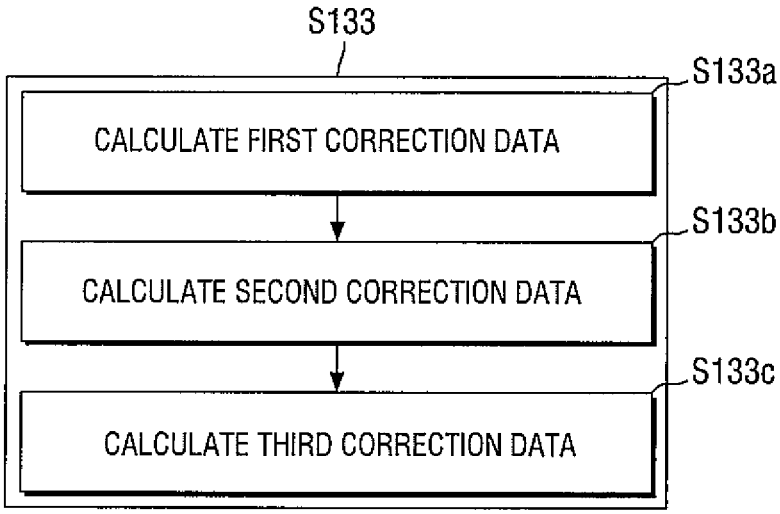
FIG. 14 is a flowchart illustrating an operation of calculating correction data using corrected luminance distribution data according to an embodiment of the present invention.

Referring to FIGS. 12 through 14, the defect (e.g., stain) correction method includes acquiring image data for each reference gray level by capturing an image on a display panel 20 which displays the image corresponding to each of first through third reference gray levels (e.g., preset first through third reference gray levels) G1 through G3 (operation S110), calculating luminance distribution data P1, P2 or P3 of the display panel 20 for each reference gray level from the image data for each reference gray level (operation S120), calculating correction data C based on the luminance distribution data P1, P2 or P3 for each reference gray level (operation S130), and correcting gray data input to the display panel 20 using the correction data C (operation S140).

For example, an image for each gray level displayed on the display panel 20 is captured (operation S110).

The display panel 20 is a panel that displays an image. The display panel 20 may be an LCD panel, an electrophoretic display panel, an OLED panel, an LED panel, an inorganic EL display panel, an FED panel, an SED panel, a PDP, or a CRT display panel. An OLED panel will hereinafter be described as an example of the display panel 20. However, the display panel 20 according to the present invention is not limited to the OLED panel, and various types of display devices and display panels may be used.

A test signal T may be provided to the display panel 20. The test signal T may correspond to each of the first reference gray level G1, the second reference gray level G2 and the third reference gray level G3. The test signal T may be provided by a signal supplier 110. The signal supplier 110 may change a reference gray level in response to a gray change signal G and provide the test signal T having the changed reference gray level to the display panel 20. The first through third reference gray levels G1 through G3 may have different gray values. A gray value of the first reference gray level G1 may be lower than that of the second reference gray level G2, and the third reference gray level G3 may correspond to a maximum gray value of gray data input to the display panel 20. For example, the first reference gray level G1 may have a gray value of 35, the second reference gray level G2 may have a gray value of 87, the third reference gray level G3 may have a gray value of 255, and the test signal T may be an 8-bit signal. However, the present invention is not limited to this example. In response to the test signal T, the display panel 20 may display an image having a different luminance value according to the reference gray level G1, G2 or G3. The display panel 20 may include a plurality of pixels PX arranged in a matrix. The pixels PX may be arranged in a 3×3 matrix as illustrated in FIG. 3, but the arrangement of the pixels PX is not limited to the 3×3 matrix. Each of the pixels PX includes an organic light-emitting element and can emit light by itself. The pixels PX may have different luminances due to shaped defects (e.g., stains) formed by a difference in light exposure, a difference in height of column spacers or a difference in parasitic capacitance between signal lines, as well as shapeless defects (e.g., stains) formed by a process defect such as introduction of foreign matter or pinholes.

An image acquisition unit 121 may acquire an image for each reference gray level displayed on the display panel 20. Here, the display panel 20 may be displaying an image corresponding to any one of the first through third gray levels G1 through G3 in response to the test signal T. The image acquisition unit 121 may be composed of a camera. The image acquisition unit 121 may capture an image displayed on the display panel 20 and generate image data I of the captured image. The image acquisition unit 121 may be a 3×3 CCD camera including nine cells. That is, an image displayed on the display panel 20 may be charged in each cell of the image acquisition unit 121 as an optical signal. Then, the image acquisition unit 121 may generate the image data I by converting the optical signal into an electrical signal. However, the configuration of the image acquisition unit 121 is not limited to the above example. The image acquisition unit 121 may be aligned to match each of the pixels PX. In some embodiments, the image acquisition unit 121 may be provided in a plurality, and the image acquisition units 121 may be arranged to match the pixels PX, respectively. The aligned image acquisition unit 121 may generate the image data $\underline{I}$ by capturing a first pixel PX1.

Next, luminance distribution data is calculated (operation S120).

The image acquisition unit 121 may transmit the generated image data $\underline{I}$ to a first control unit 122 of a luminance calculator 120. The first control unit 122 may calculate luminance distribution data P of the display panel 20 by converting the image data I. The first control unit 122 may include a temporary memory, and the image data I acquired by the image acquisition unit 121 may be stored in the temporary memory. The first control unit 122 may convert each image data I into a luminance value in view of exposure time, lens focus characteristics, boundary surface correction, camera noise, etc. and calculate the luminance distribution data P of the display panel 20. The first control unit 122 may calculate first luminance distribution data P1 corresponding to the first reference gray level G1, second luminance distribution data P2 corresponding to the second reference gray level G2, and third luminance distribution data P3 corresponding to the third reference gray level G3. That is, after calculating the first luminance distribution data P1, the first control unit 122 may instruct the signal supplier 110 to change the gray level of the test signal T to the second gray level G2 by outputting the gray change signal G to the signal supplier 110. In addition, after calculating the second luminance distribution data P2, the first control unit 122 may instruct the signal supplier 110 to change the gray level of the test signal T to the third gray level G3 by outputting the gray change signal G to the signal supplier 110. After finally calculating the third luminance distribution data P3, the first control unit 122 may instruct the signal supplier 110 to stop providing the test signal T by outputting the gray change signal G to the signal supplier 110.

Next, correction data is calculated (operation S130).

The correction data calculator 130 may calculate correction data C based on the luminance distribution data P for each reference gray level. The correction data calculator 130 may include a second control unit 131 and a memory unit 132. The second control unit 131 may include a temporary memory and may temporarily store the luminance distribution data P provided by the luminance calculator 120 in the temporary memory. The second control unit 131 may calculate the correction data C based on the luminance distribution data P for each reference gray level.

Here, the calculating of the correction data (operation S130) may include setting a reference luminance (operation S131), correcting luminance distribution data (operation S132), and calculating correction data based on the corrected luminance distribution data (operation S133).

For example, the correction data calculator 130 may set a particular pixel among a plurality of pixels PX of the display panel 20 as a reference pixel (operation S131). The correction data C may be used to adjust luminances of correction pixels to the luminance of the reference pixel. The correction data calculator 130 may set a pixel whose luminance corresponds to the average luminance as the reference pixel or a pixel corresponding to a center of the display panel 20 as the reference pixel. However, the method of setting the reference pixel is not limited to the above examples.

Luminance distribution data is corrected (operation S132). The correction data calculator 130 may correct the luminance distribution data P by linearizing a change in luminances of the pixels PX according to a gray level and generate corrected luminance distribution data P' that reflects correction values. That is, the correction data calculator 130 may correct the luminance distribution data P by linearizing a gray level-luminance curve in order for more accurate calculation of the correction data C. To generate the corrected luminance distribution data P' by linearizing the pixels PX, the luminance calculator 130 may multiply each of the pixels PX by an inverse function of a gamma graph (or gamma curve) of the reference pixel. However, a method of generating the corrected luminance distribution data P' is not limited to the above example.

Correction data is calculated based on the corrected luminance distribution data (operation S133).

The luminance of the reference pixel at each reference gray level G1, G2 or G3 may be measured, and gray levels (e.g., corrected gray levels G1', G2' and G3') of the correction pixels which correspond to the luminance of the reference pixel may be calculated. The reference gray levels G1, G2 and G3 may respectively be compared with the corrected gray levels G1', G2' and G3' for each pixel to calculate the correction data C in each range.

That is, the correction data calculator 130 may calculate first correction data C1 used to correct gray values of input data of correction pixels in a range of the first reference gray level G1 to the second reference gray level G2 such that the correction pixels have the same luminance value as that of the reference pixel in the range of the first reference gray level G1 to the second reference gray level G2 (operation S133*a*).

In addition, the correction data calculator 130 may calculate second correction data C2 used to correct input gray values of the correction pixels in the range of the second reference gray level G2 to the third reference gray level G3 such that the correction pixels have the same luminance value as that of the reference pixel in the range of the second reference gray level G2 to the third reference gray level G3 (operation S133*b*).

Also, with reference to the first correction data C1, the correction data calculator 130 may calculate third correction data C3 used to correct gray values of input data of the correction pixels in the range of a gray level of zero to the first reference gray level G1 such that the correction pixels have the same luminance value as that of the reference pixel in the range of the gray level of zero to the first reference gray level G1 (operation S133*c*).

That is, in the defect (e.g., stain) correction method according to the current embodiment, it is possible to calculate the first through third correction data C1 through C3 used to correct input gray values of correction pixels in the entire gray range from a minimum gray level (e.g., zero) to a maximum gray level (e.g., the third reference gray level G3). The first through third correction data C1 through C3 which correspond to each correction pixel excluding the reference pixel may be stored in the memory unit 132 in the form of an LUT.

Finally, gray data input to the display panel 20 is corrected using the calculated correction data (operation S140).

The memory unit 132 may provide the correction data C to the display panel 20. The correction data C may be used to correct all gray values (e.g., ranging from the minimum gray level to the maximum gray level) of gray data input to each correction pixel. Therefore, an increased (e.g. improved) correction effect can be provided. Since the input gray data can be corrected up to the maximum gray level, the maximum gray value of the corrected gray data may increase. For example, if the input gray data is an 8-bit signal having a maximum gray level of 255, the maximum gray level of the input gray data corrected using the correction data C may increase to more than 255, and the corrected gray data may expand to become a 9-bit signal.

In the defect (e.g., stain) correction method according to the current embodiment, gray data input to correction pixels excluding a reference pixel can be corrected using the first through third correction data C1 through C3. Therefore, the correction pixels can have substantially the same luminance as that of the reference pixel, and luminance non-uniformity due to defects (e.g., stains) on a display panel can be reduced (e.g., corrected). In addition, since many gray levels (e.g., all gray levels) of input gray data are reduced (e.g., corrected), an increased (e.g., improved) correction effect can be provided.

Other features of the defect (e.g., stain) correction method are substantially the same as those of the stain correction system 10 described above with reference to FIGS. 1 through 11, and thus a description thereof will be omitted.

Figure 15:
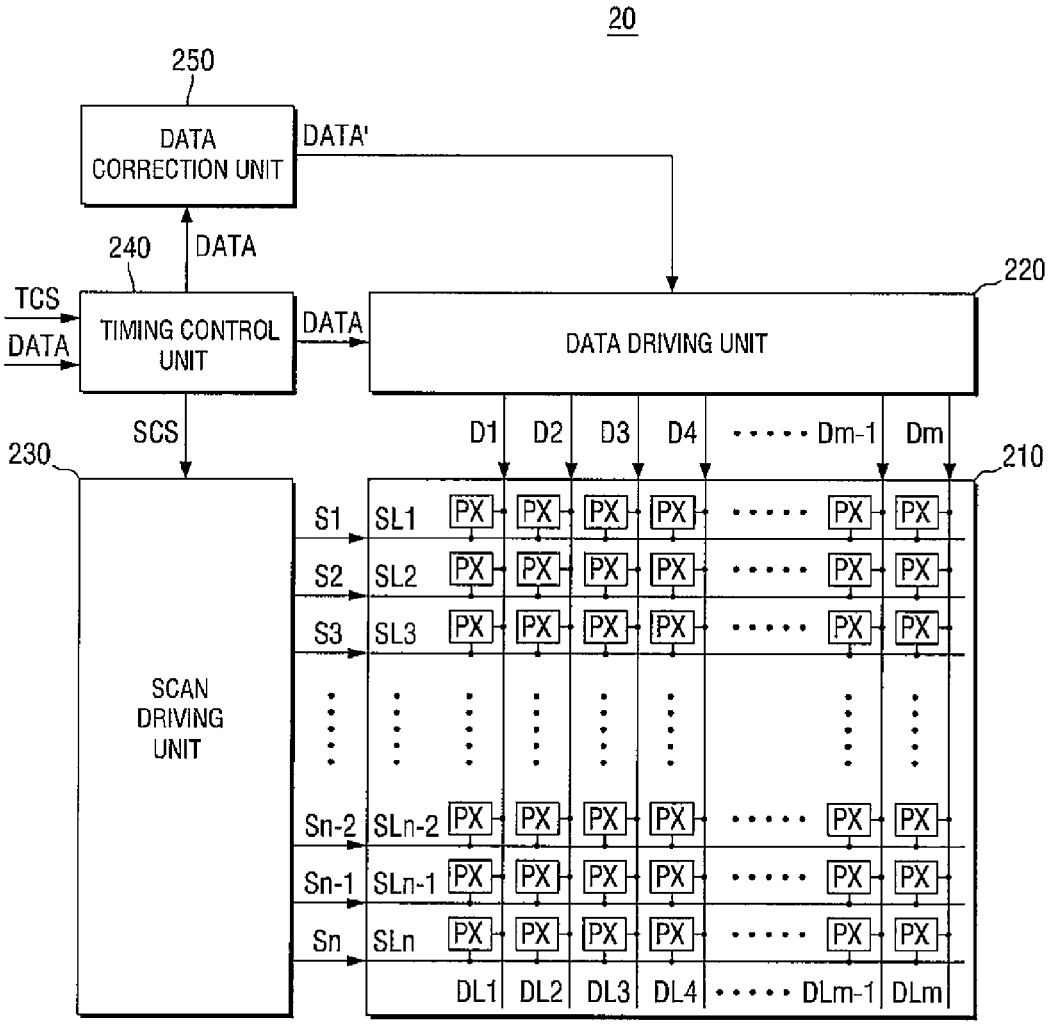
FIG. 15 is a block diagram of a display panel according to another embodiment of the present invention.
Figure 16:
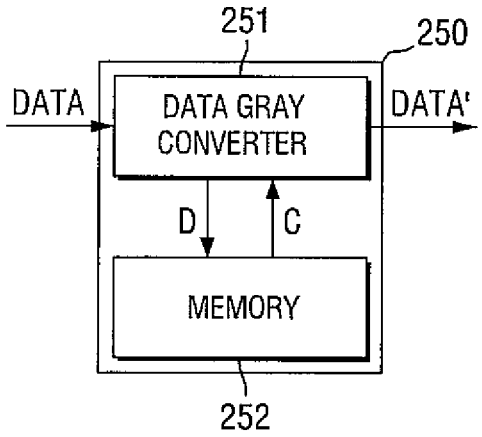
FIG. 16 is a block diagram of a data correction unit of the display panel illustrated in FIG. 15.
Figure 17:
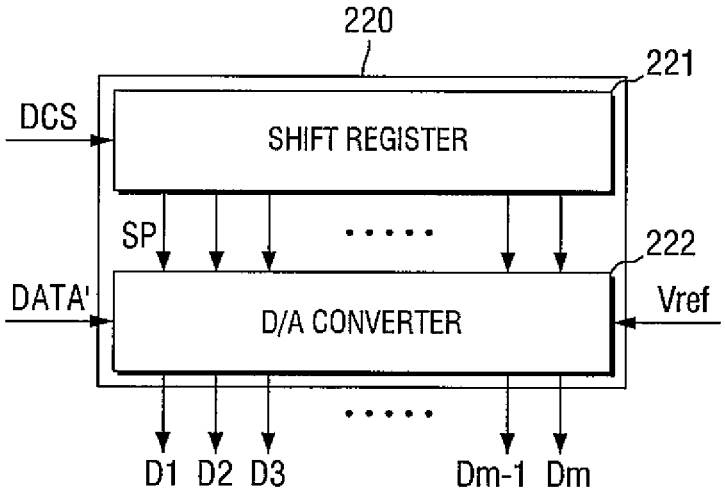
FIG. 17 is a block diagram of a data driving unit of the display panel illustrated in FIG. 15.

FIG. 15 is a block diagram of a display panel 20 according to another embodiment of the present invention. FIG. 16 is a block diagram of a data correction unit 250 of the display panel 20 illustrated in FIG. 15. FIG. 17 is a block diagram of a data driving unit 220 of the display panel 20 illustrated in FIG. 15.

Referring to FIGS. 15 through 17, the display panel 20 includes a display unit 210, the data driving unit (or a data driver) 220, a scan driving unit (or a scan driver) 230, a timing control unit (or a timing controller) 240, and the data correction unit (or data corrector) 250.

The display unit 210 may be an area where an image is displayed. The display unit 210 may include a plurality of scan lines SL1 through SLn, a plurality of data lines DL1 through DLm crossing the scan lines SL1 through SLn at crossing regions, and a plurality of pixels PX, each pixel being coupled to one of the scan lines SL1 through SLn and one of the data lines DL1 through DLm. The scan lines SL1 through SLn may extend along a first direction and may be substantially parallel to each other. The scan lines SL1 through SLn may include first through $n^{th}$ scan lines SL1 through SLn that are arranged sequentially. Each of the data lines DL1 through DLm may cross the scan lines SL1 through SLn at crossing regions. That is, the data lines DL1 through DLm may extend along a second direction perpendicular to the first direction and may be substantially parallel to each other. Here, the first direction may correspond to a row direction, and the second direction may correspond to a column direction. Data voltages D1 through Dm may be applied to the data lines DL1 through DLm. The pixels PX may be arranged in a matrix, but are not limited thereto. Each of the pixels PX may be coupled to one of the scan lines SL1 through SLn and one of the data lines DL1 through DLm. Each of the pixels PX may receive a data voltage applied to a coupled data line in response to a scan signal received from a coupled scan line. Here, the pixels PX may include a reference pixel. The reference pixel may be a pixel at a center of the display unit 210. However, the present invention is not limited thereto, and the reference pixel may be a pixel whose luminance corresponds to the average of luminances of the pixels before defect (e.g., stain) correction is performed. That is, the pixels PX may be divided into the reference pixel and pixels other than the reference pixel.

The scan driving unit 230 may receive a scan control signal SCS from the timing control unit 240. In response to the scan control signal SCS, the scan driving unit 230 may output a plurality of scan signals S1 through Sn to the display unit 210.

The timing control unit 240 may receive a timing control signal TCS from an external source and generate the scan control signal SCS for controlling the scan driving unit 230 and a data control signal DCS for controlling the data driving unit 220. The timing control signal TCS may be a vertical synchronization signal Vsync, a horizontal synchronization signal Hsync, a data enable signal DE or a clock signal CLK. In addition, the timing control unit 240 may receive gray data DATA from the external system. The gray data DATA may be provided to the data correction unit 250.

The data correction unit 250 may correct the gray data DATA into corrected gray data DATA'. That is, the data correction unit 250 may generate the corrected gray data DATA' by correcting the gray data DATA input to pixels other than the reference pixel. The corrected gray data DATA' may be used to correct the gray data DATA input to the pixels such that the pixels can have the same luminance value as that of the reference pixel. Here, all gray levels of the gray data DATA may be corrected. That is, all gray levels from a minimum gray level (e.g., zero) to a maximum gray level (e.g., 255) may be corrected, and, accordingly, the maximum gray value of the gray data DATA may increase. For example, since a correction pixel for displaying a luminance corresponding to the gray level of 255 of the reference pixel can have a gray value greater than 255, the maximum gray value of the corrected gray data DATA' may increase. Therefore, the corrected gray data DATA' may have a greater number of bits than the input gray data DATA. For example, the input gray data DATA may be an 8-bit signal, and the corrected gray data DATA' may be a 9-bit signal.

The data correction unit 250 may include a data gray converter 251 and a memory 252. The data gray converter 251 may correct the input gray data DATA into the corrected gray data DATA', and the memory 252 may be a space in which the correction data C is stored in the form of an LUT. The correction data C may be generated by the stain correction system 10 of FIGS. 1 through 11 and will not be described here. The data gray converter 251 may receive the input gray data DATA and read correction data C corresponding to the gray data DATA from the memory 252. That is, the memory 252 may provide the correction data C, which corresponds to a read-out signal D received from the data gray converter 251, to the data gray converter 251. The data gray converter 251 may generate the corrected gray data DATA' by correcting the input gray data DATA using the correction data C and output the corrected gray data DATA' to the data driving unit 220.

The data driving unit 220 may convert the corrected gray data DATA' into the data voltages D1 through Dm. The data driving unit 220 may include a shift register 221 and a digital-analog converter 222. The shift register 221 may receive the data control signal DCS from the timing control unit 240 and sequentially supply sampling pulses SP to the digital-analog converter 222 in response to the data control signal DCS. In addition, the digital-analog converter 222 may receive a reference voltage Vref from a gray voltage generator and the corrected gray data DATA' from the data correction unit 250. The digital-analog converter 222 may convert the corrected gray data DATA' in a digital waveform into a plurality of data voltages D1 through Dm in an analog form in response to the sequentially supplied sampling pulses SP and the reference voltage Vref. The digital-analog converter 222 may output the data voltages D1 through Dm to the display unit 210. Here, the digital-analog converter 222 may correspond to the number of bits of the corrected gray data DATA' in order to process the corrected gray data DATA'. For example, the digital-analog converter unit 222 may be, but is not limited to, 9 bits.

Embodiments of the present invention provide at least one of the following features.

Since defects (e.g., stains) on a display panel can be corrected, display quality can be increased (e.g., improved).

However, the effects of the present invention are not restricted to the ones set forth herein. The above and other effects of the present invention will become more apparent to one of ordinary skill in the art to which the present invention pertains by referencing the claims, and equivalents thereof.

While the present invention has been particularly shown and described with reference to example embodiments thereof, it will be understood by those of ordinary skill in the art that various changes in form and detail may be made herein without departing from the spirit and scope of the present invention as defined by the following claims, and equivalents thereof. The example embodiments should be considered in a descriptive sense only and not for purposes of limitation.

What is claimed is:

1. A system for correcting defects on a display panel, the system comprising:

a signal supplier configured to supply a test signal corresponding to each of a first reference gray level, a second reference gray level, and a third reference gray level to the display panel;

a luminance calculator configured to capture an image for each reference gray level displayed on the display panel in response to the test signal and to calculate luminance distribution data of the display panel for each reference gray level; and a correction data calculator configured to calculate correction data based on the luminance distribution data for each reference gray level, wherein the first, second, and third reference gray levels have different gray values, the third reference gray level corresponds to a maximum gray value of gray data input to the display panel, and the correction data increases the maximum gray value of the input gray data.

2. The system of claim 1, wherein the display panel comprises a plurality of pixels arranged in a matrix, and the correction data calculator is configured to set any one of the pixels as a reference pixel.

3. The system of claim 2, wherein the correction data calculator is configured to correct luminance values of correction pixels of the pixels other than the reference pixel to have substantially same luminance values as a luminance value of the reference pixel.

4. The system of claim 3, wherein the correction data calculator is configured to calculate first correction data for correcting gray values of input data of the correction pixels in a range of the first reference gray level to the second reference gray level such that the correction pixels have same luminance values as that of the reference pixel in the range of the first reference gray level to the second reference gray level.

5. The system of claim 4, wherein with reference to the first correction data, the correction data calculator is configured to calculate third correction data for correcting gray values of input data of the correction pixels in a range of a gray level of zero to the first reference gray level such that the correction pixels have same luminance values as that of the reference pixel in the range of the gray level of zero to the first reference gray level.

6. The system of claim 3, wherein the correction data calculator is configured to calculate second correction data for correcting gray values of input data of the correction pixels in a range of the second reference gray level to the third reference gray level such that the correction pixels have same luminance values as that of the reference pixel in the range of the second reference gray level to the third reference gray level.

7. The system of claim 2, wherein the correction data calculator is configured to set one of the pixels having an average luminance value as the reference pixel.

8. The system of claim 2, wherein the correction data calculator is configured to correct the luminance distribution data for each reference gray level by linearizing a change in luminance values of the pixels according to a gray level.

9. The system of claim 1, wherein the luminance calculator comprises:

an image acquirer configured to acquire an image of the display panel by capturing the display panel; and a first controller configured to calculate the luminance distribution data of the display panel.

10. The system of claim 1, wherein the correction data calculator comprises:

a second controller configured to calculate correction data based on the luminance distribution data for each reference gray level; and a memory configured to store the correction data in the form of a lookup table (LUT).

11. A method of correcting defects on a display panel, the method comprising:

acquiring image data of an image for each reference gray level by capturing the display panel which is configured to display an image corresponding to each of a first reference gray level, a second reference gray level, and a third reference gray level;

calculating luminance distribution data of the display panel for each reference gray level based on the image data of the image for each reference gray level;

calculating correction data based on the luminance distribution data for each reference gray level; and correcting gray data input to the display panel by using the correction data, wherein the first, second, and third reference gray levels have different gray values, the third reference gray level corresponds to a maximum gray value of gray data input to the display panel, and the correction data increases the maximum gray value of the input gray data.

12. The method of claim 11, wherein the display panel comprises a plurality of pixels arranged in a matrix, and the method further comprises setting any one of the pixels as a reference pixel.

13. The method of claim 12, wherein in the calculating of the correction data, luminance values of correction pixels of the pixels other than the reference pixel are corrected to have substantially same luminance values as a luminance value of the reference pixel.

14. The method of claim 13, wherein in the calculating of the correction data, first correction data for correcting gray values of input data of the correction pixels in a range of the first reference gray level to the second reference gray level is calculated such that the correction pixels have same luminance values as that of the reference pixel in the range of the first reference gray level to the second reference gray level.

15. The method of claim 14, wherein in the calculating of the correction data, third correction data for correcting gray values of input data of the correction pixels in a range of a gray level of zero to the first reference gray level is calculated with reference to the first correction data such that the correction pixels have same luminance values as that of the reference pixel in the range of the gray level of zero to the first reference gray level.

16. The method of claim 13, wherein in the calculating of the correction data, second correction data for correcting gray values of input data of the correction pixels in a range of the second reference gray level to the third reference gray level is calculated such that the correction pixels have same luminance values as that of the reference pixel in the range of the second reference gray level to the third reference gray level.

17. The method of claim 12, wherein the calculating of the correction data further comprises correcting the luminance distribution data for each reference gray level by linearizing a change in luminance values of the pixels according to a gray level.

18. A display panel comprising:

a display unit comprising a plurality of pixels arranged in a matrix and in which at least one of the pixels is set as a reference pixel;

a scan driver configured to transmit a scan signal to the display unit;

a data corrector configured to generate corrected gray data by correcting gray data input to correction pixels other than the reference pixel; and a data driver configured to generate a data voltage by converting the corrected gray data and to apply the data voltage to the display unit, wherein the data corrector is configured to increase a maximum gray value of the input gray data.

19. The display panel of claim 18, wherein the corrected gray data has a greater number of bits than the input gray data, and the data driver comprises a digital-analog converter which corresponds to the number of bits of the corrected gray data.

20. The display panel of claim 19, wherein the input gray data is an 8-bit signal, and the corrected gray data is a 9-bit signal.

* * * * *